United States Patent [19]

Ferraro

[11] Patent Number: 4,774,765

[45] Date of Patent: Oct. 4, 1988

[54] BLADE ASSEMBLY FEATURING VARIABLE SPAN

[75] Inventor: Frank A. Ferraro, Trumbull, Conn.

[73] Assignee: Warner-Lambert Company, Morris Plains, N.J.

[21] Appl. No.: 109,061

[22] Filed: Oct. 21, 1987

Related U.S. Application Data

[63] Continuation-in-part of Ser. No. 902,715, Sep. 2, 1986, Pat. No. 4,709,477.

[51] Int. Cl.[4] ..... B26B 21/22

[52] U.S. Cl. ..... 30/50; 30/57; 30/87

[58] Field of Search ..... 30/47, 50, 57, 87

[56] References Cited

U.S. PATENT DOCUMENTS

| | | | |
|---|---|---|---|
| 4,443,940 | 4/1984 | Francis et al. | 30/50 |
| 4,475,286 | 10/1984 | Saito | 30/87 |
| 4,492,024 | 1/1985 | Jacobson | 30/50 X |

*Primary Examiner*—E. R. Kazenske
*Assistant Examiner*—Michael D. Folkerts
*Attorney, Agent, or Firm*—Howard Olevsky

[57] ABSTRACT

According to this invention a blade assembly is created featuring pivotally mounted first and second blades with pivot and subsequent change the span of each blade in response to the amount of shaving force generated by the user.

7 Claims, 3 Drawing Sheets

BLADE ASSEMBLY FEATURING VARIABLE SPAN

CROSS REFERENCE TO RELATED APPLICATION

This appication is a continuation-in-part of U.S. Ser. No. 902,715, filed Sept. 2, 1968, now U.S. Pat. No. 4,709,477.

FIELD OF THE INVENTION

This invention relates to a dynamic shaving system and particularly a shaving system in which the span of the blade changes with forces exerted during shaving.

BACKGROUND OF THE INVENTION

It has long been recognized that shaving a flexible complex surface like the face with an immovable system such as the conventional razor produces nicks, cuts and lack of uniformity of shaving due to the varying face profile of the shaver. Closeness of the shave is dependent upon, among other factors, the angle of contact between face and blade as well as the flow of skin immediately preceding contact with the blade. One of the factors controlling this flow of skin is the distance between the blade edge and the surface of the blade assembly which contacts the face immediately prior to the blade edge. This distance measured by the tangential line between the face engaging points of the blade and the leading surface is known as span. In a two blade system, each blade has a separate span. The leading or bottom blade has a span determined by the tangent line drawn between its edge and the leading edge of the guard bar which is part of the blade support structure and designed to, at least in part, direct skin flow to the blade. The second blade has a span measured by a tangent line drawn between the first and second blade. In the case of the two blade system the first or bottom blade determines the skin flow to the second blade.

Several attempts have been made in the past to control the shaving properties of the blade assembly by providing the blade assembly with flexible or moveable components in various combinations. U.S. Pat. No. 4,516,320 issued May 14, 1985 to Anthony J. Peleckis discloses a blade assembly with flexible blades and spacer which move downward in response to shaving forces and the guard bar which flexes inward and upward.

U.S. Pat. No. 4,443,939 issued to Vincent C. Motta and Ernest F. Kiraly on Apr. 24, 1984 describes a blade assembly in which a cap and guard bar as well as blades and spacer are flexible and tend to conform to the facial curves of shaving pressures applied.

U.S. Pat. No. 4,069,580 issued to Cyril A. Cartwright et al issued Jan. 24, 1978 and U.S. Pat. No. 4,409,735 also issued to Cartwright et al on Oct. 18, 1983 disclose a flexible razor produced by utilizing a flexible guard bar and flexible cap as well as flexible blades and spacers. A series of ten patents issued to Chester F. Jacobson U.S. Pat. No. 4,587,729 issued May 13, 1986 being the latest, describes a blade assembly with blades which are individually biased move linearly reciprocally in response to shaving forces. In several of these patents, Jacobson also teaches the same type of movement for a guard bar.

SUMMARY OF THE INVENTION

According to this invention a blade assembly is created featuring pivotally mounted first and second blades with pivot and subsequent change the span of each blade in response to the amount of shaving force generated by the user.

BRIEF DESCRIPTION OF THE DRAWINGS

The blade assembly of this invention can be readily understood by reference to the drawings which.

DETAILED DESCRIPTION OF THE INVENTION

Figure 1:
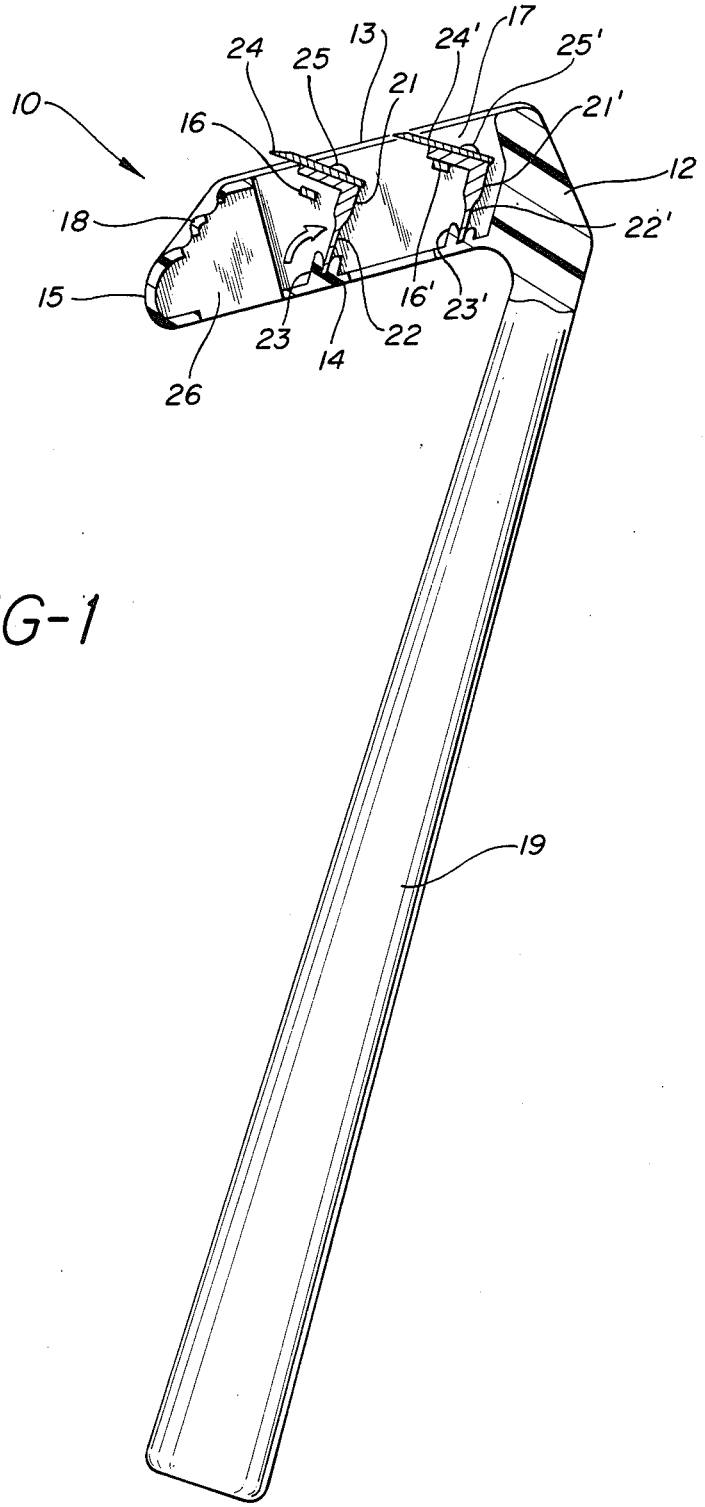
FIG. 1 is a side view partially in cross section.
Figure 3:
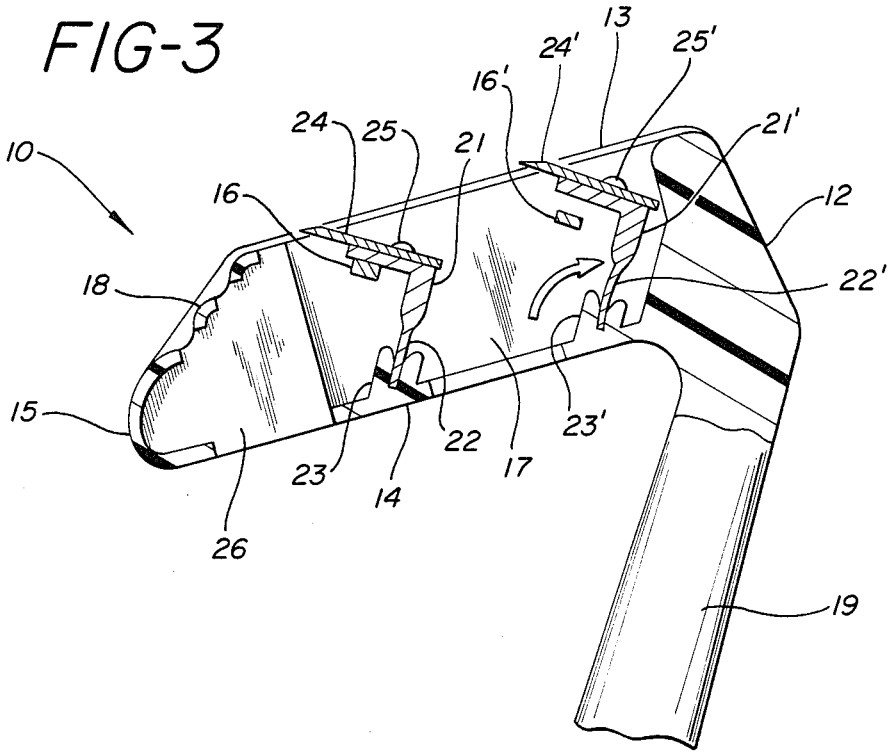
FIG. 3 is a side view partially in cross section of the razor blade assembly which is the subject of this invention.

This can be seen by reference to the drawings and particular FIGS. 1 and 3, a razor blade assembly 10 is mounted upon a handle 19. The blade assembly has a bottom portion 14, a front portion 15 and a back portion 12 with both the front and back portions upstanding from the bottom portion 14. An upper portion 13 shown here as a frame extends from the front to the back portion and stops 16 and 16' extend outward from side portion 17.

Again referring to FIG. 3, blades 24 and 24' are mounted upon fingers 21 and 21' respectively by means of stakes 25 and 25'. The fingers 21 and 21' are connected to the bottom of the blade assembly housing 14 by means of leaf spring 22 and 22'. The movement of the leaf spring is restricted by matching shoulders 23 and 23' which extend upward from the bottom of 14 of each blade assembly 10. In the embodiment shown, the leaf spring is allowed to flex to "open" the space between guard bar 18 and blade 24 (as shown in FIGS. 1 and 2 and between blade 24 and blade 24' as shown in FIG. 3).

Conventionally, razor spans for each blade and to vary between 0.040 and 0.065 in. depending upon the desired predetermined setting. According to this invention each individual span can vary between 0.040 and 0.090 in. in response to the pressure exerted during shaving. The pressure acts sequentially against the first and then the second blade to increase the distance of the span by exerted forces against the biasing action of the springs 22 and 22'.

Figure 2:
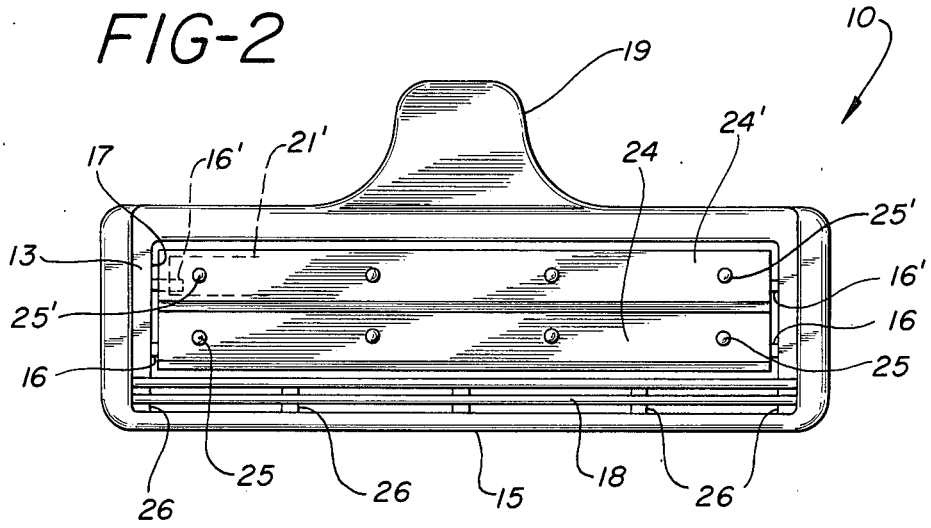
FIG. 2 is a top plan view.

As can be seen by reference particularly FIGS. 2 and 3, each of the blades 24 and 24' are held in place by stakes to the underlying fingers 21 and 21', of necessity, are staked separately.

As can be seen in FIG. 2, the razor appears visually similar to any of the disposable razors. It should be noted that the cap is not shown in FIG. 2 but with both blades closed, the plan view of this razor is similar to others currently available. As shown therein, the guard bar 18 extends toward the blades 21 and 21' and is connected to the bottom of the razor frame 14 by means of ribs 26.

Figure 4:
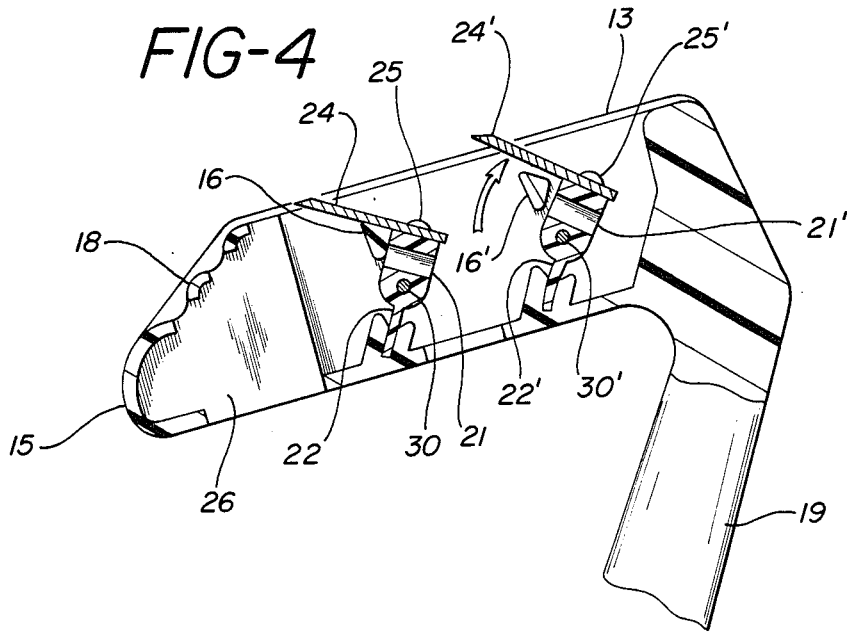
FIG. 4 is a side view partialy in cross section of a second embodiment of the blade assembly of this invention.

The embodiment shown in FIG. 4 is similar to that shown in the other figures except that specific pivot sites 30 and 30' are added to the fingers 21 and 21'. These pivot sites may be in the form of pins extending through the fingers from each side of the razor or a single pin extending transversely from one side of the razor to the other.

The embodiment restricts the compressability of the springs 22 and 22′ but also controls precisely the pivot arc of travel of each of the blades 24 and 24′ via stops 16 and 16′.

Variations will readily suggest themselves to those skilled in the art. For example, a conventional spacer can be used as stop 16′ for maintaining the minimum span of second blade 24′. Also, shoulders at 23 and 23′ can be extended to form abutments for fingers 16 and 16′ to control the span defining biasing movement. It should be noted, that in response to shaving pressure the blades move only toward the rear to expand the span and return to their original non-pressured position in the forward direction after shaving forces have been removed. This invention, therefore, provides a simply mechanical means by altering the skin flow of each blade of a multi blade system in response to pressure curing shaving generated by the user.

We claim:

1. A blade assembly comprising in combination:

(a) a frame with a cap portion, an essentially flat bottom portion, a front portion and a back portion having parallel sides joining said portions, said front and back portions extending upward from said bottom portion, a hollow central portion defined front and back by inner faces of said front and back portion, said front portion including a guard bar formed on the top of said front portion;

(b) a first blade support mounted on said bottom portion and extending upward to support a first blade, said blade support including pivoting means in the form of a pivot pin extending through said support at a point between portion and said blade and which allows movement of the first blade along a predetermined path about the axis of said pivot pin to change the span of said first blade in response to pressures exerted during shaving; and (c) a second blade support mounted on said bottom portion and extending upward to support a second blade, said blade support including pivoting means in the form of a pivot pin located at a point between said bottom portion and said blade and which allows movement of the second blade along a predetermined path about the axis of said pivot pin to change the span of said second blade independent of the change in span of said first blade, only said blades being movable in said blade assembly relative to the cap and guard portions.

2. The blade assembly of claim 1 wherein the blades shaving edges are parallel to each other when not subjected to shaving forces.

3. The blade assembly according to claim 1 wherein the blades are mounted on said blade supports by staking.

4. The blade assembly according to claim 1 wherein a first and a second stop depend inward from the sides of said frame to limit pivotal movement of said first and said second blades.

5. The blade assembly of claim 1 wherein the pivot means includes a leaf spring projecting from the bottom portion.

6. The blade assembly accorind to claim 5, wherein shoulders extend from said bottom of said frame to surround a major portion of the length of said leaf springs.

7. The blade assembly according to claim 1 wherein the span of said first and said second blade varies between 0.040 and 0.090 in response to shaving pressure.

* * * * *